US007770744B2

(12) United States Patent
Scharf et al.

(10) Patent No.: US 7,770,744 B2
(45) Date of Patent: Aug. 10, 2010

(54) ROPE WINDING SYSTEM FOR WINDING AND UNWINDING STEEL ROPES OF CRANES

(75) Inventors: Thorsten Scharf, Mannheim (DE); Ingo Noeske, Zweibruecken (DE)

(73) Assignee: Terex Demag GmbH, Zweibruecken (DE)

( * ) Notice: Subject to any disclaimer, the term of this patent is extended or adjusted under 35 U.S.C. 154(b) by 343 days.

(21) Appl. No.: 11/579,099

(22) PCT Filed: Apr. 29, 2005

(86) PCT No.: PCT/EP2005/004661

§ 371 (c)(1),
(2), (4) Date: Feb. 27, 2007

(87) PCT Pub. No.: WO2005/105656

PCT Pub. Date: Nov. 10, 2005

(65) Prior Publication Data

US 2007/0228202 A1 Oct. 4, 2007

Related U.S. Application Data

(60) Provisional application No. 60/566,549, filed on Apr. 29, 2004.

(51) Int. Cl.
*B65H 59/10* (2006.01)

(52) U.S. Cl. ..... 212/271; 188/65.1

(58) Field of Classification Search ..... 212/271; 188/65.1

See application file for complete search history.

(56) References Cited

U.S. PATENT DOCUMENTS

| | | | | |
|---|---|---|---|---|
| 3,512,757 | A | 5/1970 | Ostrom | |
| 3,543,060 | A * | 11/1970 | Holmes et al. | 310/13 |
| 4,509,376 | A | 4/1985 | Thomasson | |
| 5,299,662 | A * | 4/1994 | Reddy et al. | 187/251 |
| 6,019,200 | A * | 2/2000 | Janzen et al. | 188/163 |
| 6,502,734 | B1 * | 1/2003 | Umlauf | 226/172 |

FOREIGN PATENT DOCUMENTS

DE 3149082 6/1983

(Continued)

OTHER PUBLICATIONS

Rotzler, "Rotzler Titan Compact", (Feb. 2007), at http://www.rotzler.com.

(Continued)

*Primary Examiner*—Thomas J. Brahan
(74) *Attorney, Agent, or Firm*—Simpson & Simpson, PLLC

(57) ABSTRACT

The present invention relates to a rope winding system (1) for winding and unwinding a steel rope (4) of a crane (7). A rope winding system (1) according to the present invention has a rope drum (6), onto which the steel rope (4) can be wound in a plurality of layers, and a magnetic system (7) which is configured to generate a magnetic field over a section of the steel rope (4) with its magnetic flux being deflected by a movement of the steel rope (4) in such a way that the steel rope (4) is braked. A crane (7) is also discloses which is equipped with such a rope winding system (1) for winding and unwinding a steel rope (4).

26 Claims, 5 Drawing Sheets

FOREIGN PATENT DOCUMENTS

| | | | | |
|---|---|---|---|---|
| DE | 4316120 | | | 11/1994 |
| DE | 19903094 | | | 8/2000 |
| GB | 555522 | | | 8/1943 |
| GB | 820051 | | | 9/1959 |
| GB | 1152410 | | | 5/1969 |
| JP | 55-8932 | A | * | 1/1980 |
| JP | 59-59008 | A | * | 4/1984 |

OTHER PUBLICATIONS

Rotzler, "Rotzler Pulling Winches", (Feb. 2007), at http://www.rotzler.com.
Rotzler, "Rotzler Hoisting Winches", (Feb. 2007), at http://www.rotzler.com.
Rotzler, "Rotzler Titan", (Feb. 2007), at http://www.rotzler.com.
Rotzler, "Rotzler Treibmatic", (Feb. 2007), at http://www.rotzler.com.

* cited by examiner

ROPE WINDING SYSTEM FOR WINDING AND UNWINDING STEEL ROPES OF CRANES

CROSS-REFERENCE TO RELATED APPLICATIONS

The present application claims the benefit under 35 U.S.C. §371 of PCT Application No. PCT/EP2005/004661, filed Apr. 29, 2005 which is hereby incorporated by reference in its entirety. Further, the present application claims priority under 35 U.S.C. §119 (e) of U.S. Provisional Patent Application No. 60/566,549 filed Apr. 29, 2004 which is incorporated by reference in its entirety.

TECHNICAL FIELD OF THE INVENTION

The present invention relates to rope winding systems for winding and unwinding steel ropes of a crane, and to a crane which is equipped with such a rope winding system. Cranes of the construction of interest comprise for example mobile cranes, in particular telescopic boom cranes, but also tower slewing cranes, in particular top and bottom slewing cranes.

BACKGROUND OF THE INVENTION

Generally rope winding systems are well known which use various techniques or constructions in order to apply a more or less constant load to a steel rope while it is wound onto a rope drum of a rope winch, in particular of a crane, so that the steel rope can be uniformly wound onto the rope drum in several layers.

For example, pressure rollers are used in order to avoid slack rope problems in spooling operations. The pressure rollers used do not, however, always contact the entire width of the rope drum, so that the pressure roller experiences different loads as the rope is wound up. The use of pressure rollers results in high wear and tear of the steel rope. Also, pressure rollers tend to skip, which may lead to damage. The skipping may be due, for example, to the rope drum not being entirely uniformly wound. Such a design is sold, for example, by the firm Rotzler (Germany).

In another approach to solve the problem of winding up or down a steel rope, outer and inner rope drums are provided, as disclosed in DE 43 16120 A1. A continuous rope can be wound onto a storing drum and a working drum wherein the working drum surrounds the storing drum and is concentrically mounted to the latter on the drum shaft. The drum housing of the working drum is provided with an axially extending gap for passing the rope, and the working drum is freely rotatable on the drum shaft. A clutch for the non-rotating coupling of the working drum to the storing drum is also provided. In this arrangement, the rope length not needed for a particular operating mode is stored on the storing drum. During operation, the rope on the working drum is almost entirely wound and unwound. This makes it possible to avoid winding up the rope while a load is applied onto layers of windings that have become loose. The rope can be loosely wound onto the inner storing drum at each required rope length, as it is only stored thereon. This construction is, however, very complex and only results in transferring the rope to the inner drum. No load is built up on the rope and only unused lengths of rope are transferred.

From DE 199 03 094, two rope drums arranged side by side, are known. Herein, a hoist rope drum and a storing drum are fixedly linked coaxially with each other and axially offset from each other, and are driven by a common drive motor.

Both the hoist line drum and the storing drum are always commonly driven, wherein the hoist line section stored on the storing drum is not loaded.

A line haul for steel cable including one or more power sheaves ahead of a cable storage drum is shown in U.S. Pat. No. 3,512,757. Each sheave has as circumferential groove in which the cable fits closely and unlike magnet poles are spaced transversely of the groove to produce a flux path intersecting the groove transversely of its length and pathing through the cable transversely of its length. The principle object of such an arrangement is to increase the traction between a cable bight and the groove of a sheave in which such cable bight is received without reliance primarily on the force of friction between the cable and the surface of the sheave groove.

From GB 820,051 A, a capstan device for use in hauling steel cable is known. It is emphasized that it would be important to know precisely the length of a cable passing over the device and to ensure that the cable is not damaged in the process. Difficulty has arisen in the past since there is almost inevitably appreciable slip. The device shown in GB 820,051 A comprises means disposed within a cable-engaging member to provide a magnetic field having a component normal to the external surface and thus tending to retain the cable in contact with that surface.

In GB 1,152,410 A an overhead traveling crane or lift driven by a linear induction motor is shown, in which a laminated moving member totally surrounds a portion of a length of a stationary member to obtain maximum tractional effort.

Finally, U.S. Pat. No. 4,509,376 shows a dynamometer, used to measure the tension on, speed of, and direction of movement of a hoist rope on a crane. The dynamometer includes a frame comprising three spaced apart blocks coupled to one another by pairs of thin flexible resilient portions. Two pulleys are mounted to the outermost blocks while an offset pulley, coupled to a tension monitoring load cell, is mounted to a central block and presses against the rope. One pulley has three permanent magnets embedded about its periphery, two being axially spaced across from another and the third spaced radially 180 degrees from the others. Sensors mounted to the frame are positioned to sense the passing of the magnets to provide rope speed and direction of travel information in digital form. Tension information from the load cell and speed and direction information from the sensors are supplied to a microprocessor for processing.

SUMMARY OF THE INVENTION

According to a first aspect of the present invention, a rope winding system is provided which reliably facilitates uniform winding of a steel rope onto a rope drum. A rope winding system of the present invention for winding and unwinding a steel rope of a crane comprises a rope drum, onto which the steel rope is to be wound in several layers, and a magnetic system which is arranged in such a way that a magnetic field can be generated with its magnetic flux being deflected by a movement of the steel rope in such a way that the steel rope is braided.

The invention is based on the idea that at least a section of the steel rope is exposed to a magnetic field, which is in particular stationary, in such a way that when the steel rope moves, i.e. for example during a rope winding operation, a direct rope load is exerted on the steel rope. By moving the steel rope through the magnetic field, a force component is generated which exerts a direct rope load on the rope and therefore brakes it, which results in an improved winding-up operation. The braking effect is generated by deflecting the rope in the magnetic field. In particular, there is no mechanical contact between the magnetic system of the rope winding system and the steel rope. The mechanical stress on the steel rope can therefore preferably be kept to a minimum and wear and tear is minimal. It has to be noted that the magnetic system can be arranged in the vicinity of the rope drum or in a distance therefrom. In an exemplary embodiment of the invention the magnetic system is arranged in front of the rope drum. Alternatively, a considerable distance between the rope drum and the magnetic system can be arranged and further components such as e.g. one or more deflection pulleys for deflecting the rope dropping out of the magnetic system can be arranged between the rope drum and the magnetic system. It can be sufficient that a braking force is exerted on the rope acting to ensure that tension is maintained on portion of the rope between the rope drum and the magnetic system. Hence, the implementation of the present invention is relatively easy and can be adapted to existing arrangement without problems.

In an exemplary embodiment of the invention, the rope winding system further comprises a rope guiding apparatus.

In another exemplary embodiment of the present invention, a rope winding system is provided in which the rope guiding means comprises further guiding means. The guiding means are for example, guiding pulleys, for example each arranged in opposing pairs in front of and behind the magnetic system, in order to guide the steel rope.

In another exemplary embodiment of the present invention, the magnetic system has an eddy current brake. Since the brake does not touch the steel rope in order to exert a braking force, it is free of wear and tear and therefore provides for low-cost maintenance. The functioning of the eddy current brake is based on the law of induction. Eddy current brakes consist of an iron yoke with a plurality of pole cores. Electric windings excite the brake magnetically in such a way that alternating electric north and south poles occur. When the rope is moved through the excited eddy current brake, magnetic fields caused by the eddy currents are generated from which the braking force results. Since there is no contact between the brake and the rope, the wear and tear on the rope is minimized.

In another exemplary embodiment of the present invention, any other type of magnetic system may also be used, such as a hysteresis brake which is capable of deflecting the rope in the magnetic field to thereby brake it.

In another exemplary embodiment of the present invention, the magnetic system of the rope winding system can be connected to an electric current supply.

In another exemplary embodiment of the present invention, the rope guiding means of the rope winding system has a load detecting means to measure a load, i.e. the rope load applied to the steel rope.

In another exemplary embodiment of the present invention, the load detecting means of the rope winding system is a sensor. The load detecting means can include a load detector which can be mounted on the rope guiding means in any desired way. It may be advantageous for the load detector to be integrated into the yoke of the magnetic system.

In another exemplary embodiment of the present invention, the sensor is mounted on the magnetic system. The magnetic system may be, for example, a means for adjusting the braking force exerted on the steel rope and therefore the rope load of the steel rope, so that the latter may be continuously detected and controlled, with or without feedback, making it possible for an optimal rope load to be applied whenever the steel rope is wound onto the rope drum.

In another exemplary embodiment of the present invention, the rope winding system comprises a hoist line drum as the rope drum. According to another aspect of the present invention the rope drum may be electrically driven. In another exemplary embodiment of the present invention, the rope drum may be hydraulically or mechanically driven.

In another aspect of the present invention, a crane is also suggested, which is equipped with a rope winding system of the type described above. The crane can be, for example, a tower slewing crane, a lattice tower crane, a mobile crane or any other type of crane.

It should be appreciated that such a rope winding system could, of course, also be used in other installations, such as on board ships, where the above-described problems can occur.

BRIEF DESCRIPTION OF THE DRAWINGS

For explanation and better understanding, an exemplary embodiment of the present invention will be described in more detail below with reference to the accompanying drawings, in which.

DESCRIPTION OF AN EXEMPLARY EMBODIMENT OF THE PRESENT INVENTION

Figure 1:
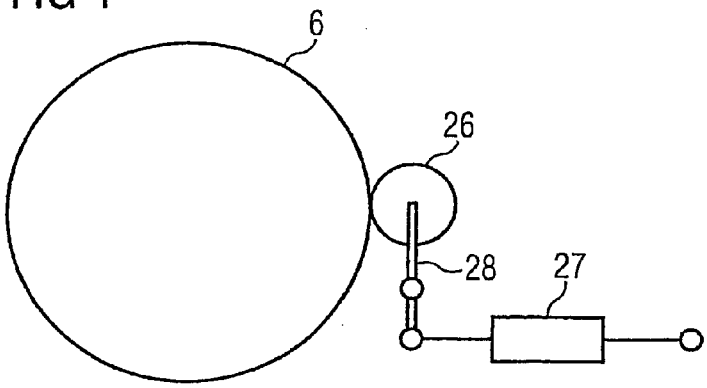
FIG. 1 is a side view of an arrangement for winding up a steel rope onto a rope drum.

FIG. 1 shows a side view of an apparatus for winding up a steel rope onto a rope drum 6 of the conventional type, which uses a pressure roller 26 to generate a rope load. Pressure roller 26 is linked to a hydraulic cylinder 27 via a lever 28. Pressure roller 26 serves to lay the steel rope and should prohibit a lift-off the rope at slack rope problems.

Figure 2:
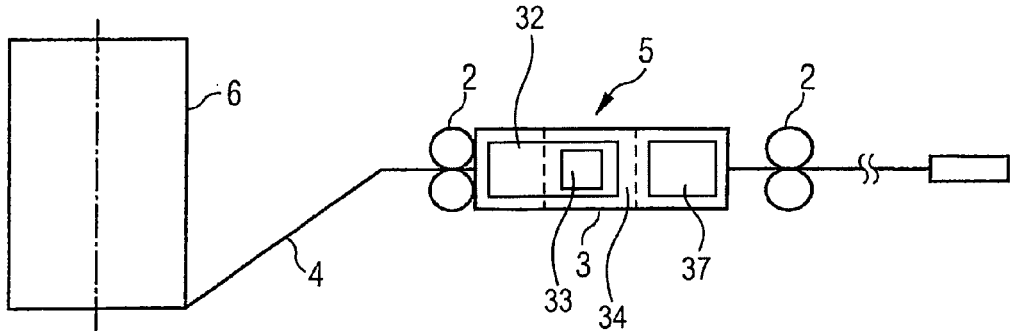
FIG. 2 is a side view of a rope winding system according to the present invention.

FIG. 2 shows, in a side view, a rope winding system 1 according to the present invention. To generate a rope load on steel rope 4, a magnetic system 3 in the form of an eddy current brake is used. When rope drum 6 winds up steel rope 4, an electric current is supplied to eddy current brake 3 and steel rope 4 is braked by the magnetic field which is deflected by the movement of steel rope 4 through the magnetic field. In front of eddy current brake 3, a pair of opposed guiding pulleys 2 is arranged, which guide steel rope 4 into the magnetic field of eddy current brake 3. After it has passed through eddy current brake 3, steel rope 4 is passed through another pair of opposed guide pulleys 2 guiding steel rope 4 in the direction of rope drum 6 onto which steel rope 4 is to be wound.

Figure 9:
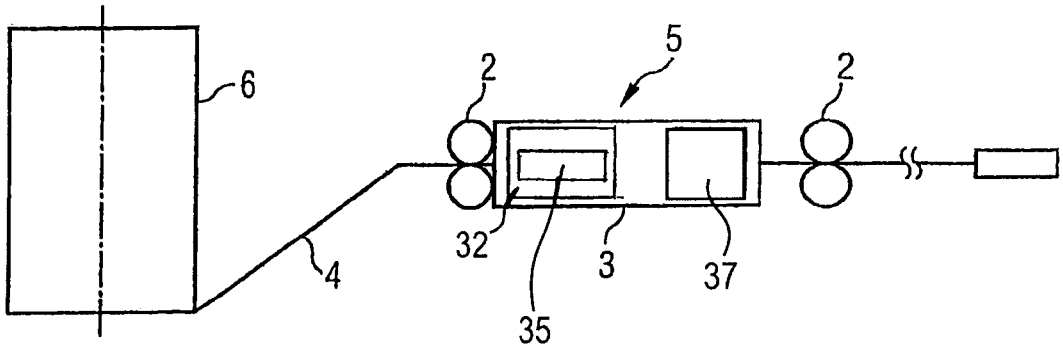
FIG. 9 is a side view of a rope winding system according to the present invention in which the load detector is a sensor; and, FIG. 10 is a top plan view of the rope winding system of FIG. 2 according to the present invention in which the load detector is a sensor within the magnetic system.
Figure 10:
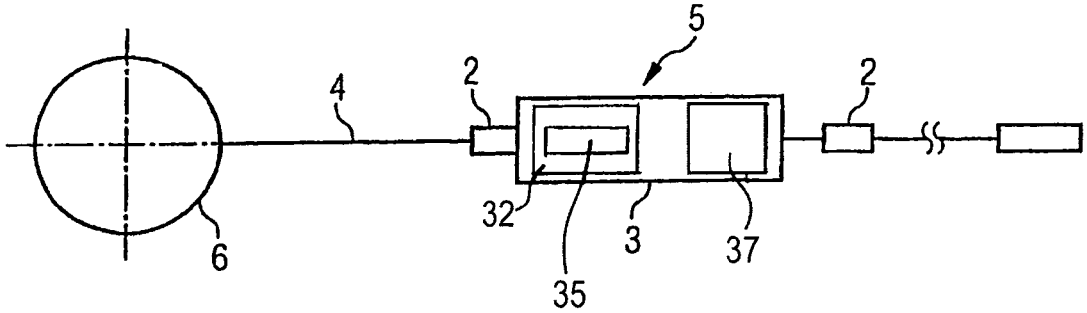

A load detection means 32 shown schematically in FIG. 2 may be provided on magnetic system 3 in the form of a sensor 35 or detector 33 mounted in the yoke 34 of magnetic system 3 (shown schematically in FIGS. 2 and 3) which detects the rope load applied to steel rope 4. Moreover, a means for controlling the rope load (not shown) applied to steel rope 4 may also be provided on magnetic system 3 so that it is possible to wind up steel rope 4 onto rope drum 6 at a given constant rope load. FIGS. 2 ands 3 show detector 33. FIGS. 9 and 10 show schematically side and top views respectively, of rope winding system 1 in which the load detecting means is sensor 35.

Figure 3:
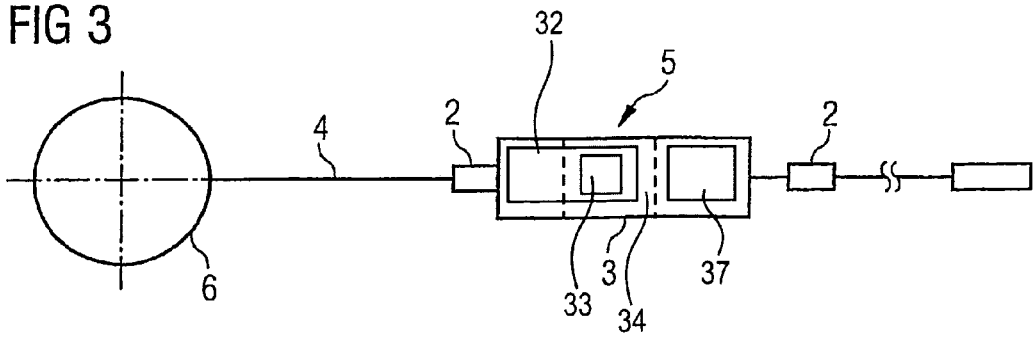
FIG. 3 is a top plan view of the rope winding system of FIG. 2 according to the present invention.

FIG. 3 shows the rope winding system 1 of FIG. 2 in a top view. It can be seen that steel rope 4 extends horizontally in a straight line toward rope drum 6, i.e. is guided by guiding pulleys 2. In the same way, steel rope 4 is also guided through eddy current brake 3 in a straight line. The direction of the movement of the rope when it is wound onto rope drum 6 is opposed to the rope load applied to steel rope 4.

Figure 4:
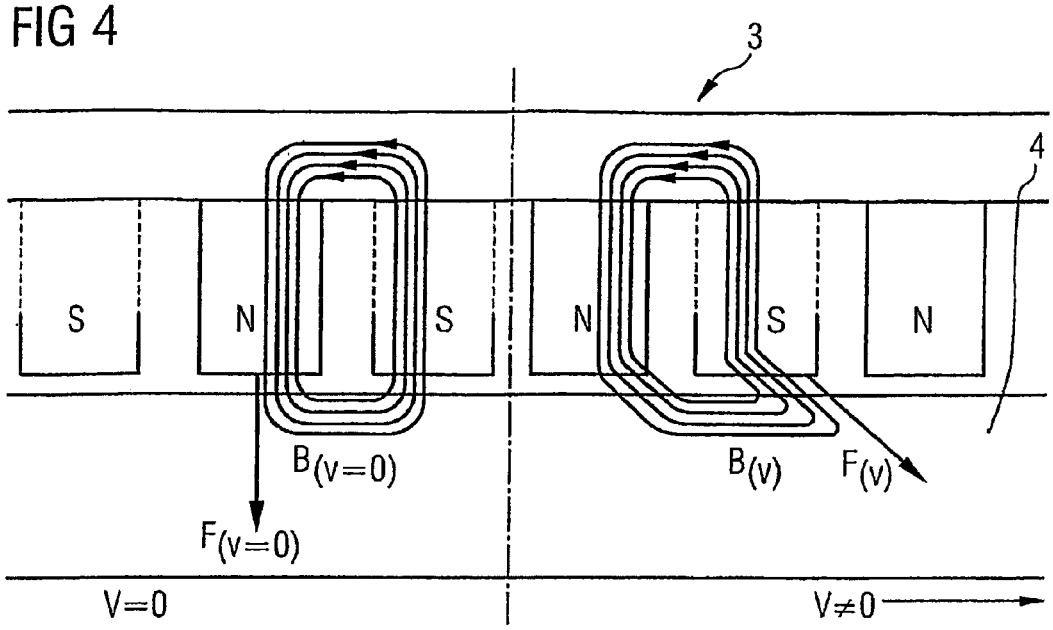
FIG. 4 shows the operation of the rope winding system of FIGS. 2 and 3 according to the present invention.

FIG. 4 illustrates the operation of the rope winding system according to the present invention. The force component F of the electric magnetic field generated by magnetic system 3 is at right angles to steel rope 4 when it does not move, i.e. when it is stationary (left half of FIG. 4). If, however, steel rope 4 begins to move, such as when it is wound onto rope drum 6, the magnetic flux of the magnetic field of magnetic system 3 is deflected (right half of FIG. 4). The force component F is no longer at right angles to steel rope 4, but is deflected. Due to this, a force acts on steel rope 4 and thus brakes it. Thus, magnetic system 3 acts as an eddy current brake 3 as shown schematically in FIG. 4.

Figure 5:
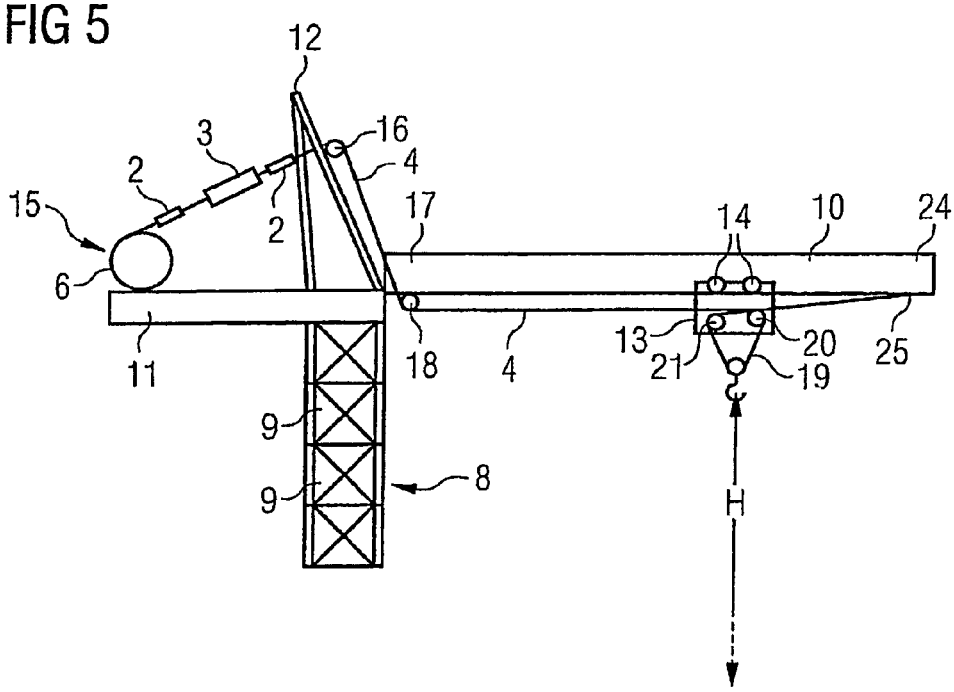
FIG. 5 is a side view of a crane equipped with the rope winding system according to the present invention.

FIG. 5 shows a side view of a crane 7, which is equipped with a rope winding system according to the present invention. The present crane is a top slewing tower type crane, having a tower 8 consisting of individual tower sections 9. Tower 1 grows in accordance with the growing height of a building in the well-known fashion in that tower sections 9 are inserted at the tower foot (not shown). A boom 10 and a counter boom 11 are supported on tower 8 by means of a slewing bearing (not shown).

On top of boom 10 and counter boom 11, tower tip 12 extends upward. A crane boom trolley 13 is guided so it can be translated on wheels 14 in the usual way. A hoist line winch 15 with a rope drum 6 is arranged on counter boom 11. Steel rope 4 is guided via a deflection pulley 16 arranged, for example, at tower tip 12, to the foot of boom 17, from where it extends to crane trolley 13 via a deflection pulley 18. Then it is rigged a number of times in a hook block and tackle 19, which is formed by pulleys 20, 21 on trolley 13 and by an equal number of pulleys 22 on hook block 23.

Steel rope 4 extends from a pulley 21 on trolley 13 further to the tip 24 of boom 10, where one end 25 of steel rope 4 is fixed. Between deflection pulley 16 and rope drum 6, magnetic system 3 is arranged, which brakes steel rope 4 in order to enable proper winding-up of the rope. In front and behind magnetic system 3, pairs of opposing guiding pulleys 2 are provided, which guide steel rope 4 from deflection pulley 16 into magnetic system 3 and further from magnetic system 3 to rope drum 6.

Figure 6:
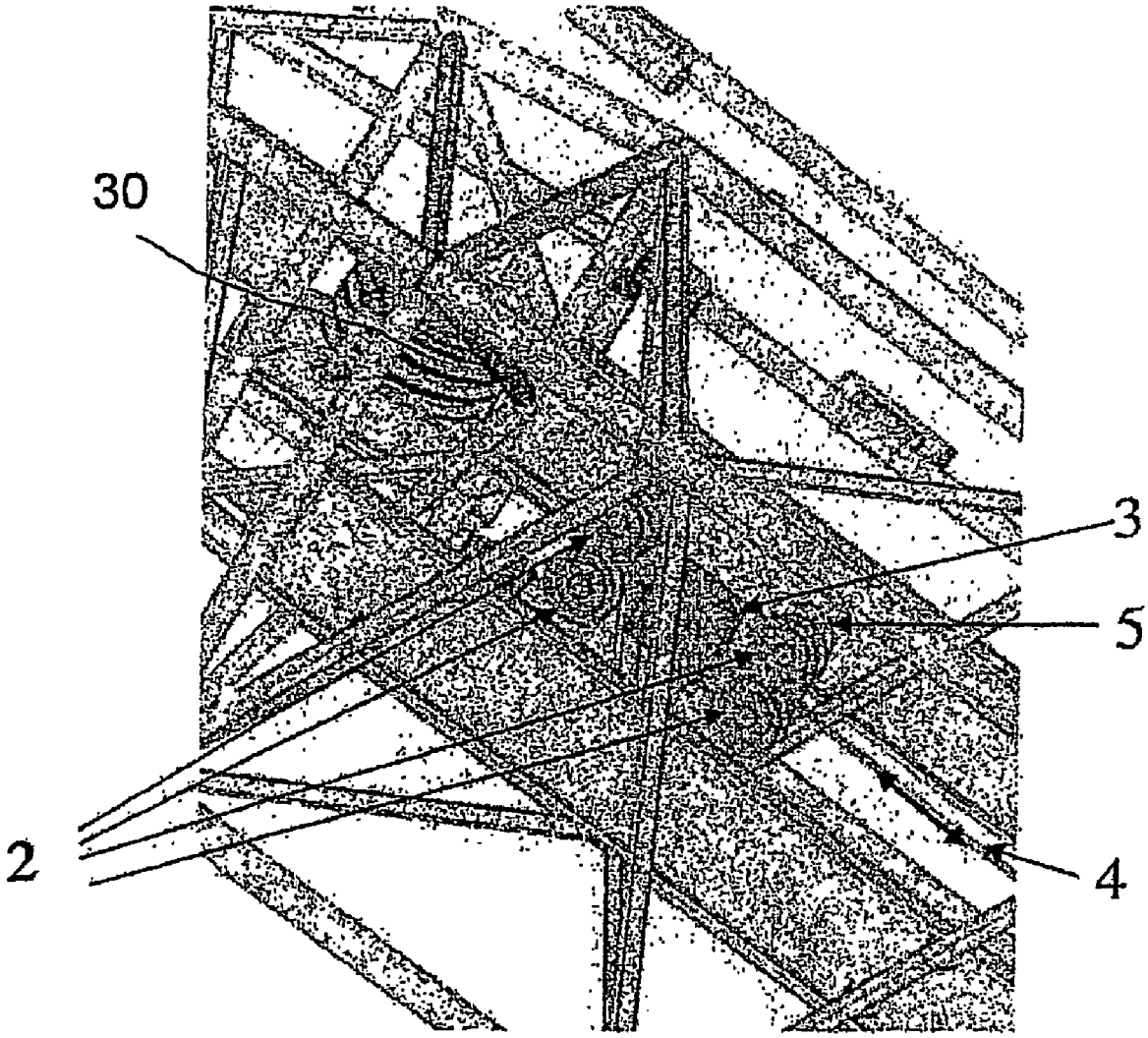
FIG. 6 is a perspective view of a part of crane equipped with the rope winding system according to the present invention.

FIG. 6 shows a lattice crane part in which steel rope 4 to be wind up on a rope drum (not shown in this drawing) is deflected on a deflection pulley 30 mounted in the lattice crane part. Magnetic system 3 is arranged in front of deflection pulley 30. Here, steel rope 4 passes through the magnetic system 3 in which a braking force is exerted on steel rope 4. Similar to the arrangement shown in FIGS. 2 and 3 the magnetic system comprises guiding pulley pairs 2 in front of and behind magnetic system 3. Although, the magnetic system 3 is arranged rather far away from a rope drum the winding up process can be improved.

Figure 7:
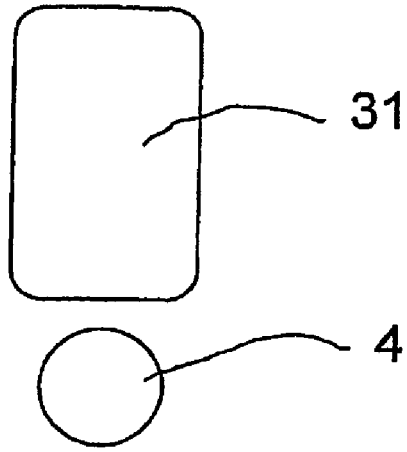
FIG. 7 is a schematic view of an exemplary embodiment of a magnetic system to be used in a rope winding system according to the present invention.

FIG. 7 shows a schematic view of an exemplary embodiment of magnetic system 3 to be used in a rope winding system according to the present invention. Here, the magnetic system comprises eddy current brake 3 with its electromagnets 31 arranged on one side of the steel rope 4.

Figure 8:
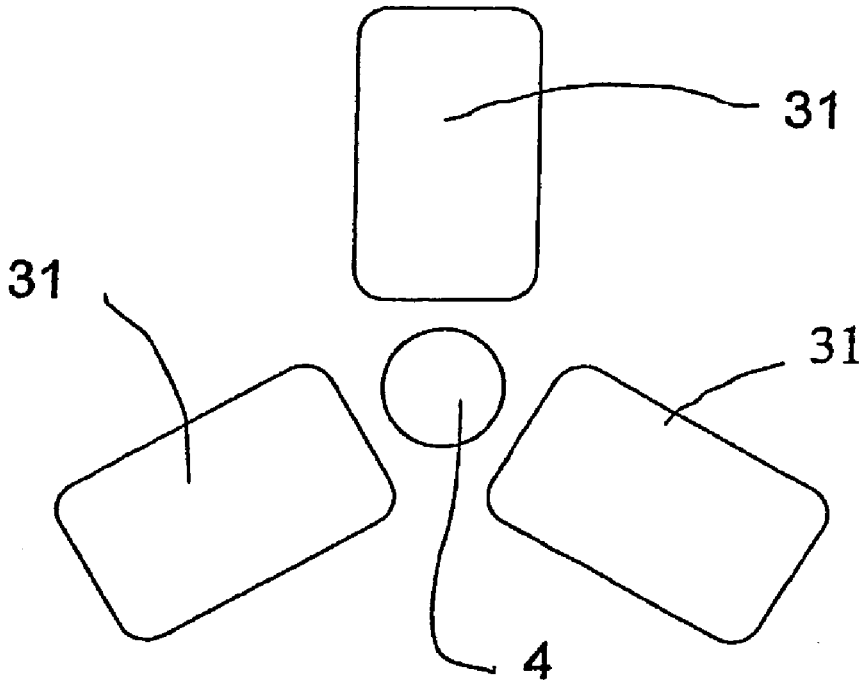
FIG. 8 is a schematic view of another exemplary embodiment of a magnetic system to be used in a rope winding system according to the present invention

The further exemplary embodiment of a rope winding system according to the present invention shown schematically in FIG. 8 comprises an eddy current brake 3 in which electromagnets 31 are arranged on a circumferential around the steel rope 4 and are uniformly distributed.

LIST OF THE REFERENCE NUMERALS

1 rope pulling system
2 guide pulleys
3 magnetic system
4 steel rope
5 rope guiding means
6 rope drum
7 crane
8 tower
9 tower sections
10 boom
11 counter boom
12 tower tip
13 crane trolley
14 wheels
15 hoist line winch
16 deflection pulley
17 foot of boom
18 deflection pulley
19 hook block and tackle
20 pulley
21 pulley
22 pulley
23 hook
24 tip of boom
25 end of steel rope
26 pressure roller
27 hydraulic cylinder
28 lever
30 deflection pulley
31 electromagnets

What is claimed:

1. A rope winding system (1) for winding and unwinding a steel rope (4) of a crane (7), comprising the steel rope (4), a rope drum (6) onto which the steel rope (4) is to be wound in several layers, a magnetic system (3) arranged in such a way that it generates a magnetic field around a section of the steel rope (4) having a magnetic flux which is deflected by a movement of the steel rope (4) in such a way that the steel rope (4) is braked, and a rope guiding apparatus (5) which includes guiding pulleys (2) arranged in opposing pairs in front of and behind the magnetic system (3) in order to guide the steel rope (4).

2. The rope winding system (1) according to claim 1, wherein the magnetic system (3) is an eddy current brake.

3. The rope winding system (1) according to claim 1, wherein the magnetic system (3) is connected to an electric current supply.

4. The rope winding System (1) according to claim 1, further comprising a load detecting means wherein said load detecting means is a sensor.

5. The rope winding System (1) according to claim 4, wherein the sensor is mounted on the magnetic System (3).

6. The rope winding system (1) according to claim 1, wherein the rope drum (6) is a hoist line drum.

7. The rope winding system (1) according to claim 1, wherein the rope drum (6) is hydraulically driven.

8. A crane comprising a rope winding system (1) said rope winding system (1) including:

the steel rope (4), a rope drum (6) onto which the steel rope (4) is to be wound in several layers, a magnetic system (3) arranged in such a way that it generates a magnetic field around a section of the steel rope (4) having a magnetic flux which is deflected by a movement of the steel rope (4) in such a way that the steel rope (4) is braked, and a rope guiding apparatus (5) which includes guiding pulleys (2) arranged in opposing pairs in front of and behind the magnetic system (3) in order to guide the steel rope (4).

9. The crane according to claim 8, wherein the crane is a mobile crane.

10. The crane according to claim 8, wherein the crane is a tower slewing crane.

11. The crane according to claim 8, wherein the rope winding system (1) further comprises a rope guiding apparatus (5).

12. The crane according to claim 11, wherein the rope guiding apparatus (5) includes guiding pulleys (2) arranged in opposing pairs in front of and behind the magnetic system (3) in order to guide the steel rope (4).

13. The crane according to claim 8, wherein the magnetic system (3) is an eddy current brake.

14. The crane according to claim 8, wherein the magnetic system (3) can be connected to an electric current supply.

15. The crane according to claim 8, wherein the rope guiding means (5) has a load detecting means to measure a load applied to the steel rope.

16. The crane according to claim 15, wherein the load detecting means includes a load detector.

17. The crane according to claim 16, wherein the load detector is integrated into a yoke of the magnetic system (3).

18. The crane according to claim 15, wherein the load detecting means is a sensor.

19. The crane according to claim 18, wherein the sensor is mounted on the magnetic System (3).

20. The crane according to claim 8, wherein the rope drum (6) is a hoist line drum.

21. The crane according to claim 8, wherein the rope drum (6) is electrically driveable.

22. The crane according to claim 8, wherein the rope drum (6) is hydraulically driveable.

23. A rope winding system (1) for winding and unwinding a steel rope (4) of a crane (7), comprising the steel rope (4), a rope drum (6) onto which the steel rope (4) is to be wound in several layers, a magnetic system (3) arranged in such a way that it generates a magnetic field around a section of the steel rope (4) having a magnetic flux which is deflected by a movement of the steel rope (4) in such a way that the steel rope (4) is braked wherein said deflection is made without physically contacting said steel rope (4); and a rope guiding apparatus (5) which has a load detecting means to measure a load applied to the steel rope (4), wherein the load detecting means includes a load detector that is integrated into a yoke of the magnetic system (3).

24. A rope winding system (1) for winding and unwinding a steel rope (4) of a crane (7), comprising:

the steel rope (4), a rope drum (6) onto which the steel rope (4) is to be wound in several layers and wherein said rope drum (6) is electrically driven, and a magnetic system (3) arranged in such a way that it generates a magnetic field around a section of the steel rope (4) having a magnetic flux which is deflected by a movement of the steel rope (4) in such a way that the steel rope (4) is braked, wherein said deflection is made without physically contacting said steel rope (4).

25. A rope winding system (1) for winding and unwinding a steel rope (4) of a crane (7), comprising the steel rope (4), a rope drum (6) onto which the steel rope (4) is to be wound in several layers, and a magnetic system (3) arranged in such a way that it generates a magnetic field around a section of the steel rope (4) having a magnetic flux which is deflected by a movement of the steel rope (4) in such a way that the steel rope (4) is braked, wherein said deflection is made without physically contacting said steel rope (4) and wherein the magnetic system (3) has a means for adjusting a braking force on the steel rope (4) and therefore the rope load of the steel rope (4), in order to continuously detect and control the rope load for applying an optimal rope load whenever the steel rope (4) is wound onto the rope drum (6).

26. A rope winding system (1) for winding and unwinding a steel rope (4) of a crane (7), comprising the steel rope (4), a rope drum (6) onto which the steel rope (4) is to be wound in several layers, and a magnetic system (3), said magnetic system being a hysteresis brake that is arranged in such a way that it generates a magnetic field around a section of the steel rope (4) having a magnetic flux which is deflected by a movement of the steel rope (4) in such a way that the steel rope (4) is braked, wherein said deflection is made without physically contacting said steel rope (4).

* * * * *